US006186751B1

(12) United States Patent
Rigo

(10) Patent No.: US 6,186,751 B1
(45) Date of Patent: Feb. 13, 2001

(54) HEAD AND SILENCER OF A REFRIGERATION COMPRESSOR

(75) Inventor: Massimo Rigo, Pordenone (IT)

(73) Assignee: Zanussi Elettromeccanica S.pA., Pordenone (IT)

( * ) Notice: Under 35 U.S.C. 154(b), the term of this patent shall be extended for 0 days.

(21) Appl. No.: 09/297,600

(22) PCT Filed: Oct. 17, 1997

(86) PCT No.: PCT/EP97/05734

§ 371 Date: May 26, 1999

§ 102(e) Date: May 26, 1999

(87) PCT Pub. No.: WO98/22712

PCT Pub. Date: May 28, 1998

(30) Foreign Application Priority Data

Nov. 19, 1996 (IT) ..... PN960046 U

(51) Int. Cl.[7] ..... F04B 39/00; F04B 53/00

(52) U.S. Cl. ..... 417/312; 181/403; 417/902; 62/296

(58) Field of Search ..... 417/312, 313, 417/902; 181/229, 403, 236, 264; 62/296

(56) References Cited

U.S. PATENT DOCUMENTS 3,876,339 * 4/1975 Gannaway ..... 417/312
4,784,583 * 11/1988 Bar ..... 417/312
5,173,034 * 12/1992 Riffe ..... 417/312
5,201,640 * 4/1993 Heinzelmann et al. ..... 417/312
5,304,044 * 4/1994 Wada et al. ..... 417/312
5,496,156 * 3/1996 Harper et al. ..... 417/312
5,542,824 * 8/1996 Lee ..... 417/312
5,577,898 * 11/1996 Lee ..... 417/312
5,613,842 * 3/1997 Alfano et al. ..... 417/312
5,697,766 * 12/1997 Oh ..... 417/312
5,769,613 * 6/1998 Kim ..... 417/312
5,804,777 * 9/1998 Kim et al. ..... 181/229
5,888,055 * 3/1999 Lee ..... 417/312
5,938,411 * 8/1999 Seo ..... 417/312
5,992,170 * 11/1999 Yap ..... 62/296

* cited by examiner

*Primary Examiner*—Teresa Walberg
*Assistant Examiner*—L Fastovsky
(74) *Attorney, Agent, or Firm*—Pearne & Gordon LLP

(57) ABSTRACT

Electric compressor comprising a compression cylinder and the respective head, a valve plate arranged between the head and the body of said cylinder and provided with a gas inlet opening, a silencer arranged at the inlet side of said opening and comprising an elongated portion with an aperture adapted to fit in with said opening. The head is provided externally with a concave recess which is laterally open towards the inner cavity of the compressor, said elongated portion of the silencer being firmly housed in said recess so that the aperture engages the opening in the valve plate in an air-tight, sealed manner. In said recess there is provided a hollow space between said elongated portion and the outer wall, said hollow space being adapted to accommodate an elastic element for locking the silencer in place.

5 Claims, 8 Drawing Sheets

HEAD AND SILENCER OF A REFRIGERATION COMPRESSOR

DESCRIPTION

The present invention refers to a particular form of both the head and the suction conduit of the silencer through which the refrigerant gas flows inside a sealed casing that encloses an electric motor, as particularly used in refrigerating apparatuses for home and similar applications.

To the purpose of more effectively exemplifying the present invention, said silencer is assumed to operate in close association with the compressor and to be made of plastics moulded by the injection moulding or any other appropriate plastic moulding process, without this of course limiting the scope of the same invention to just such a kind of coupling and material.

The gas pressure oscillations inside positive displacement compressors, in particular those used in domestic refrigeration equipment, are critically important owing to the extent to which they affect both the efficiency of and the level of sound power radiated by the compressors themselves. In these compressors, it is the refrigerant gas that comes from the suction tube that enters inside the sealed casing of the compressor.

The body of the compressor has a suction tube provided inside the casing which is connected to the suction valve through a number of channels and cavities that enable the suction gas to be conveyed into the cylinder.

The basic mechanisms governing the gas motion dynamics and, more generally, the state of the art are described in the Italian patent application no. PN0014 filed by the same Applicant, to which reference should therefore be made for obvious reasons of conciseness and of which the present invention shall be intended as constituting an improvement.

To the purpose of reducing the noise emissions from the suction conduit, the practice is commonly known of mounting a silencer element at the inlet at which the gas enters the head of the compressor, said silencer practically constituting in this manner the terminal portion of the gas suction conduit.

In view of using the sound-deadening effect thereof to the greatest possible extent, such a silencer is usually applied directly on to the inflow mouth of the valve plate, with such a construction as to be able to get over the thickness of the head.

It therefore is quite obvious that the head must be given an appropriately deep recess to accomodate at least a part of the silencer, ie. the one that is applied on to the inflow mouth of the valve plate. Owing to constructive reasons, such a connection is carried out after the valve plate has been assembled on the compressor body, but before assembling the head.

Such a method, however, calls for a number of manual assembly operations to be performed, so that the automatic process used to assemble the whole compressor must necessarily be interrupted and, as a result, a much longer time is required for manufacturing the compressor owing to both said interruption of an automated process and the time required for assembling the silencer manually. This practically turns out to constitute a drawback that considerably affect the overall production efficiency.

From EP 0 195 496 it is shown an hermetic motor-compressor unit for a refrigeration circuit, where the suction or inlet plenum chamber (A) is made as a separate part (27) of a plastic material in order to reduce heat transfer from the cylinder head to the suction chamber (A).

In said document it is explained that the spring 31 is first mounted on part 27 through the protrusion 38. Then the part 27 is inserted into the slot 24.

However, the presence of the spring 31, previously mounted on said part 27, will make more difficult such insertion of part 27.

But, even more, the unavoidable scratching of the gaskets, pressed by the previously mounted spring 31, that have to be mounted between the openings 28 and the parts 30, will certainly damage said gaskets, therefore compromising the hermetic sealing between said openings and ports.

It therefore would be desirable, and it actually is a main purpose of the present invention, to provide a compressor head and silencing apparatus with such a form and size as to enable the whole assembly of the compressor to be carried out without assembling the silencer, and the silencer to be then assembled only upon completion of the actual manufacturing process, ie. after also the compressor head has been assembled.

It is a further purpose of the present invention to provide such a head and such silencer so that they enable techniques and materials to be used which are simple, cost-effective and readily available in the art.

These aims are reached in a compressor as it is described below by way of mere non-limiting example with reference to the accompanying drawings, in which.

Figure 1:
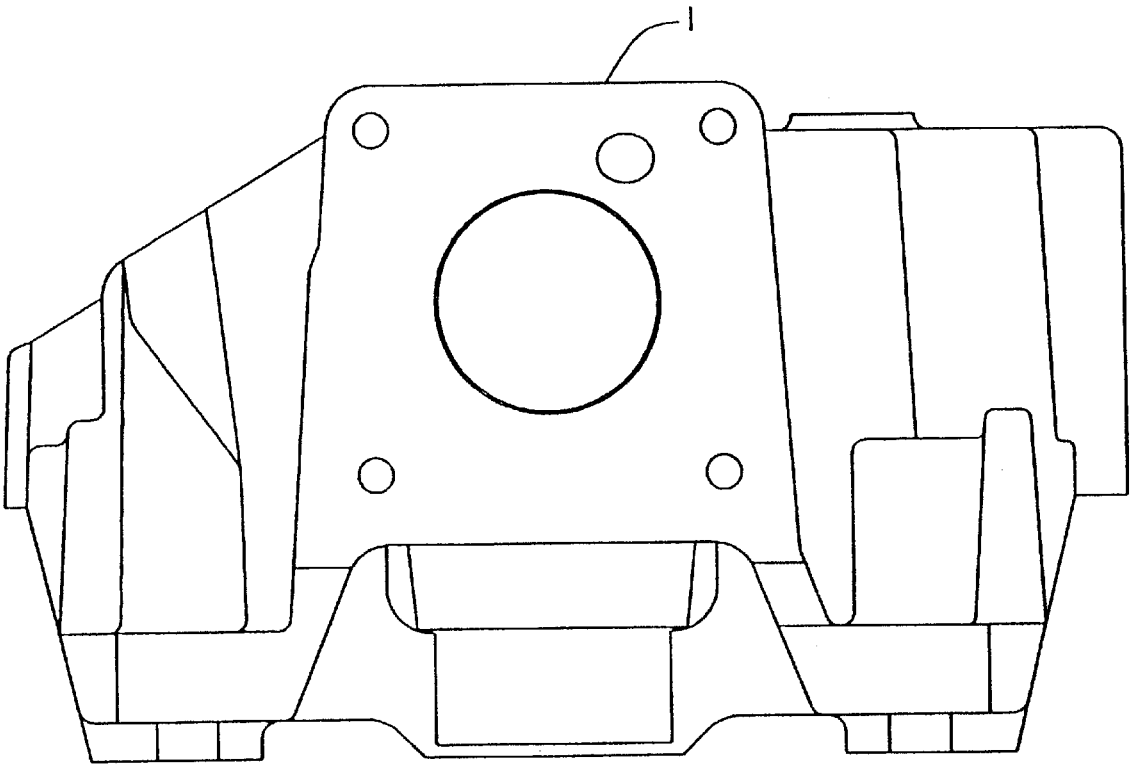
FIG. 1 is a plan top view of the compressor body without valve plate.
Figure 2:
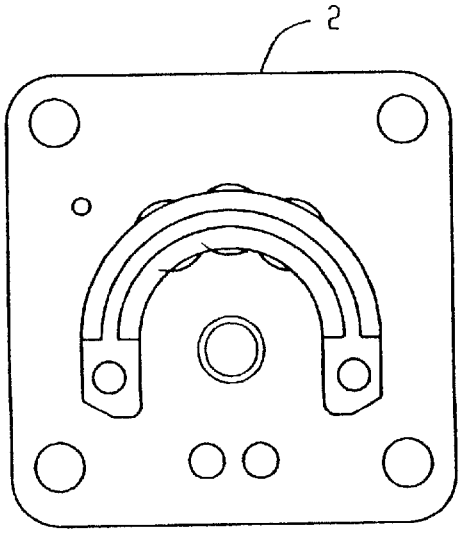
FIG. 2 is a top view of the valve plate of a compressor according to the present invention.
Figure 3:
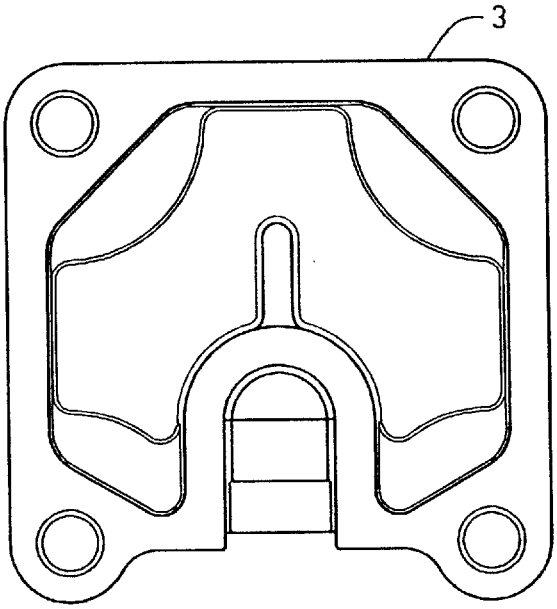
FIG. 3 is a top view of a head of a compressor according to the present invention.
Figure 4:
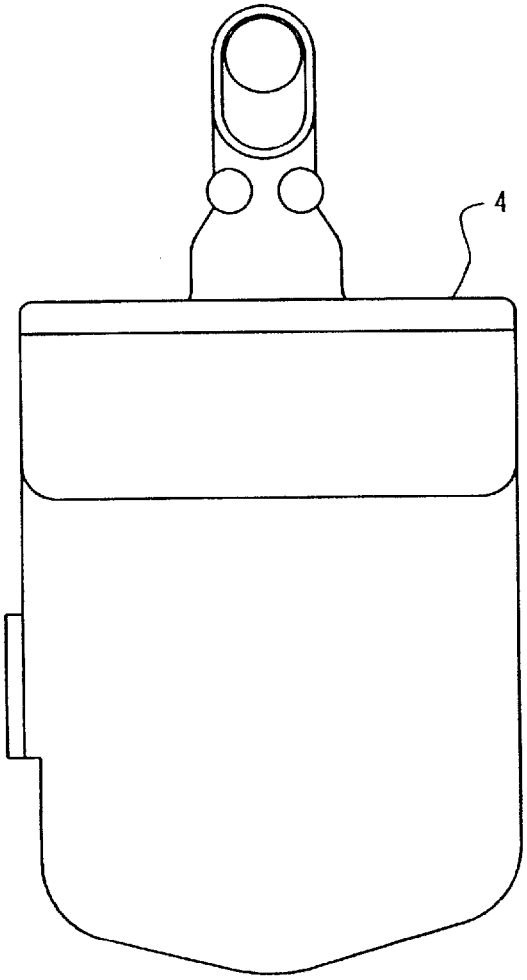
FIG. 4 is a top view of a silencer of a compressor according to the present invention.
Figure 5:
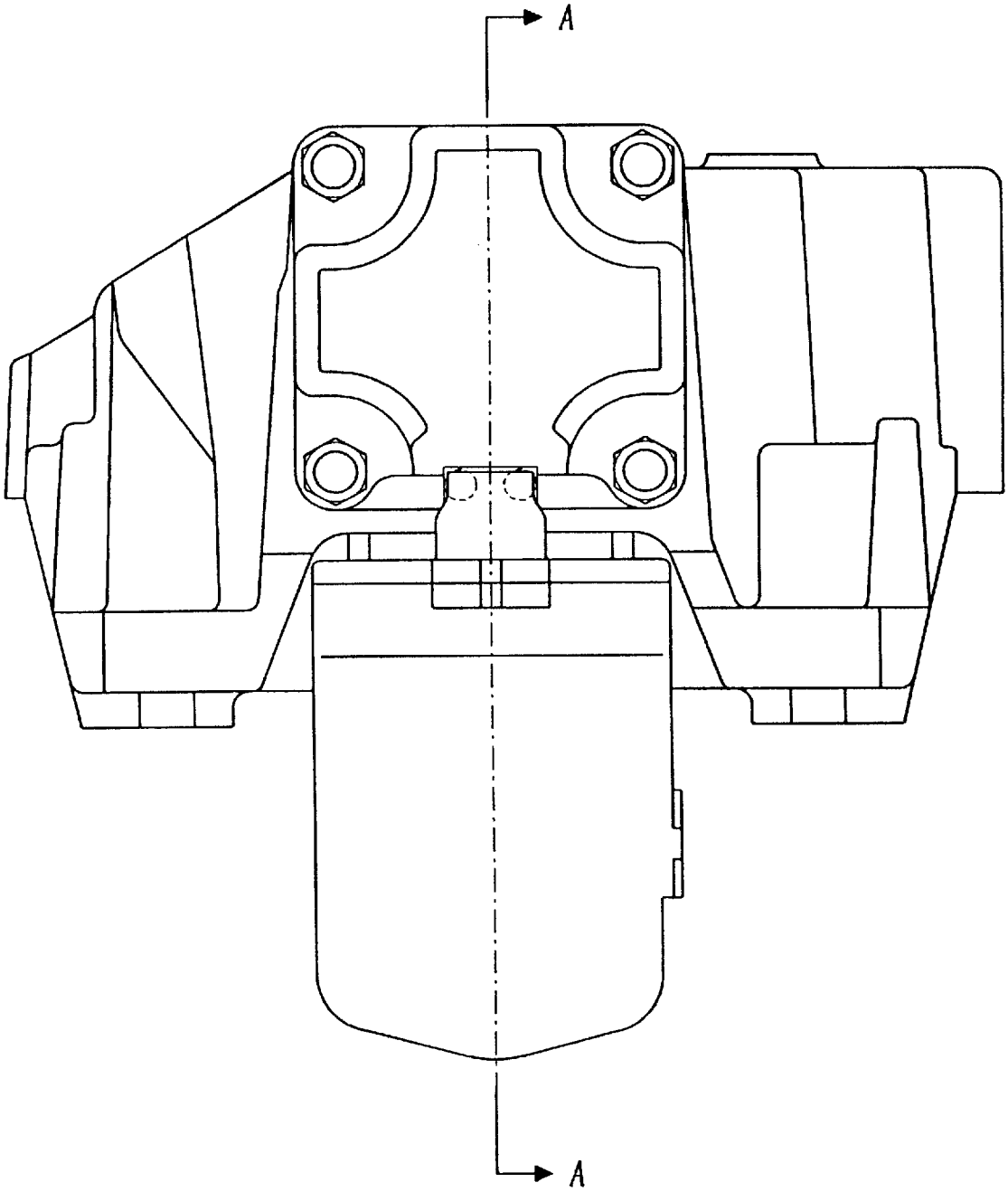
FIG. 5 is a top view of the assembly of the four component parts illustrated in the above listed Figures, shown here in their final assembly condition.

The basic idea behind the present invention is as described below:

As in the afore cited patent specification, the gas entering the compressor, and coming from the refrigerating circuit, is immediately "intercepted" by the silencer and conveyed towards the head without it being allowed to diffuse.

According to the present invention, however, both the silencer and the compressor body are so shaped and sized as to make it possible for the same silencer to be assembled after the compressor body itself has been fully assembled.

In this connection, and with reference to the above listed Figures, it can be noticed that the compressor body comprises a cylinder body 1, a valve plate 2, a head 3 of the compressor, and a silencer 4. As compared with prior-art solutions, both the cylinder body 1 and the cylinder plate 2 may be left substantially unaltered, whereas the present invention introduces definite modifications relating to the head 3 of the compressor and the silencer 4.

With reference to the compressor head 3, it can be noticed that it is provided with a projecting border 5 along its outer surface, said projecting border being formed with a side 6 that is substantially orthogonal to the surface of the plate and said side 6 extending with a second side 7 that is substantially transversal with respect to said side 6 and substantially frontal, at a certain distance therefrom, with respect to the suction opening 20 provided in the plate 2.

Furthermore, said head is so shaped as to leave uncovered a portion 8 of the plate situated therebelow, which is substantially opposing said second side 7 and, therefore, substantially encircling said suction opening 20.

Said contiguous sides 6 and 7 are geometrically associated with each other so as to subtend a recess 9 that is defined by at least said side 7 and the opposing surface of said portion 8 of the plate situated therebelow.

It is therefore quite apparent that the suction opening 20 is in this way able to let into the avove cited and defined recess 9.

The silencer 10 is in turn provided with an elongated portion 11, on a side of which there is provided an opening 12 through which the gas is ejected towards the suction opening 20 provided in the valve plate.

The mutual shapes and dimensions of the described component parts will be such, and easily identifiable by those skilled in the art in their many variants as far as both the geometry and the dimensions are concerned, as to enable said elongated portion 11 of the silencer to be progressively inserted into said recess, after the head has been assembled, until the opening 12 provided to allow the gas contained in the silencer to escape establishes a perfect and tight fit with the corresponding opening 20 provided in the valve plate.

For the silencer to be kept in position, the dimensions of the described component parts are selected in such a manner that a hollow space 23 is obtained between the outer surface 21 of said elongated portion, which is situated in front of the respective opening 20, and the inner surface 22 of said border 7; said hollow space is used to accomodate an elastic element 24 which, by acting elastically against said two mutually opposing surfaces 21 and 22, firmly holds the silencer in the desired position by blocking said elongated portion 11.

Figure 6:
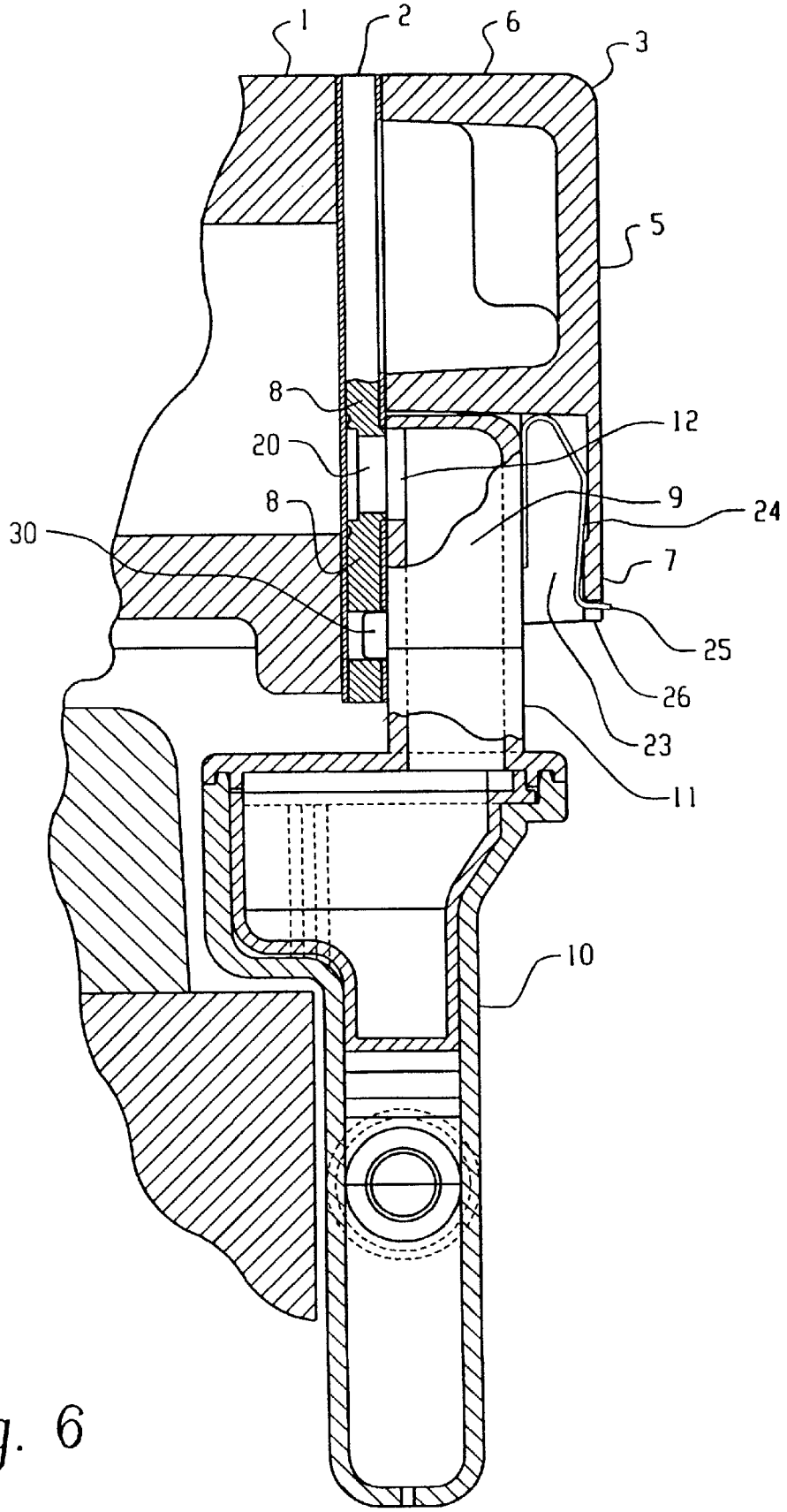
FIG. 6 is a cross-sectional view of an improved variant of a compressor according to the present invention.
Figure 7:
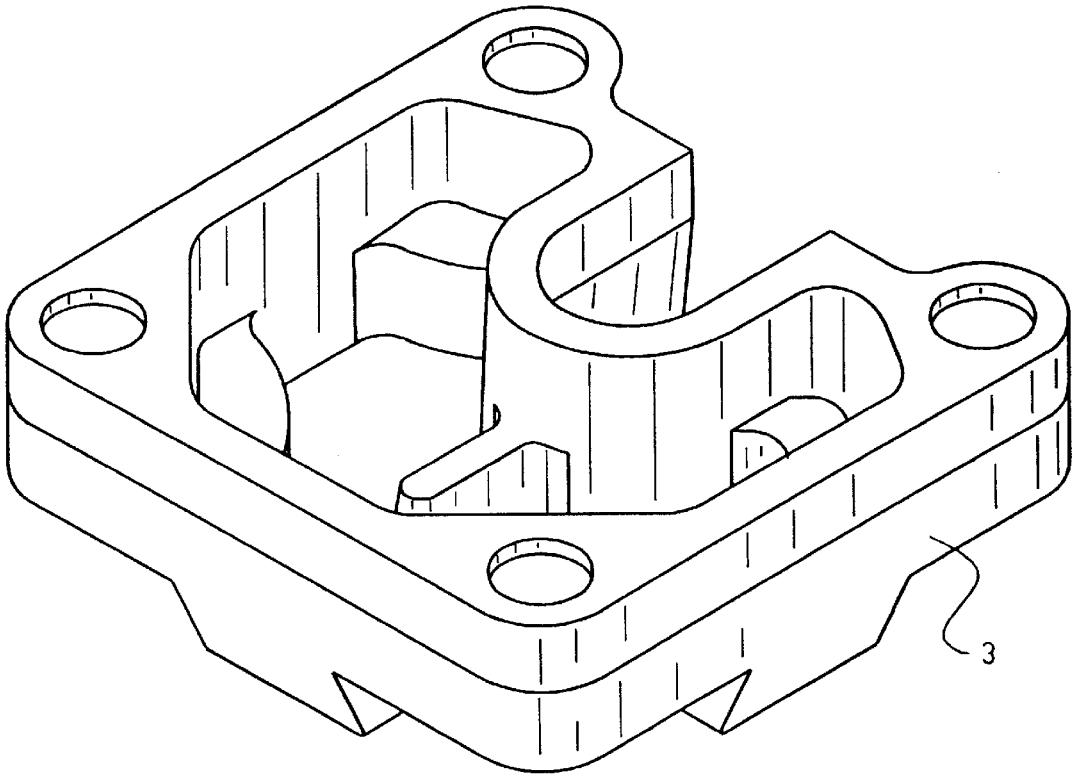
FIG. 7 is a perspective view oof a head of a compressor according to the present invention.
Figure 8:
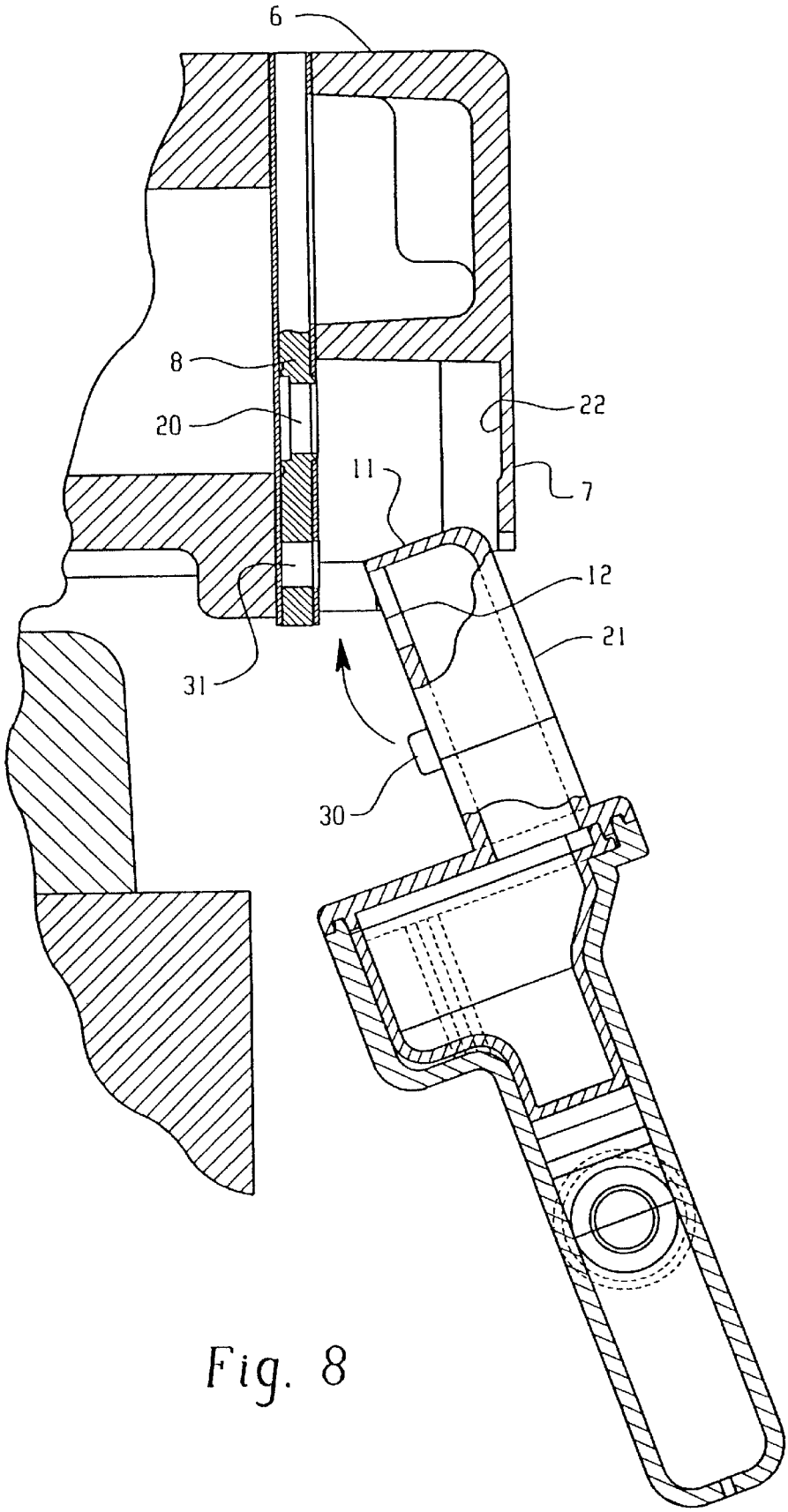
FIGS. 8 to 10 are respective views along the section plane A—A of the positions taken by a component part of the present invention at subsequent moments during the assembly thereof on the compressor head.
Figure 9:
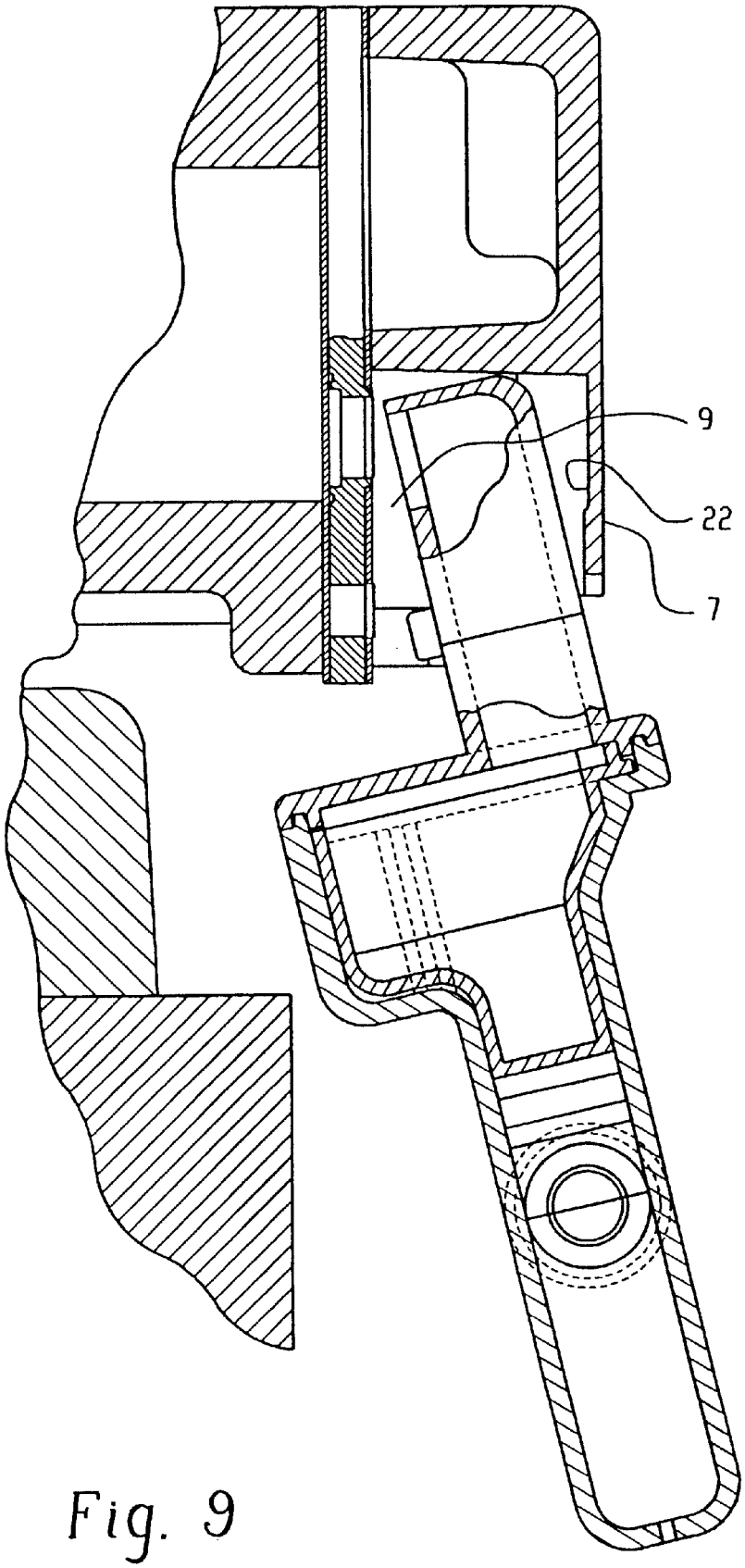
Figure 10:
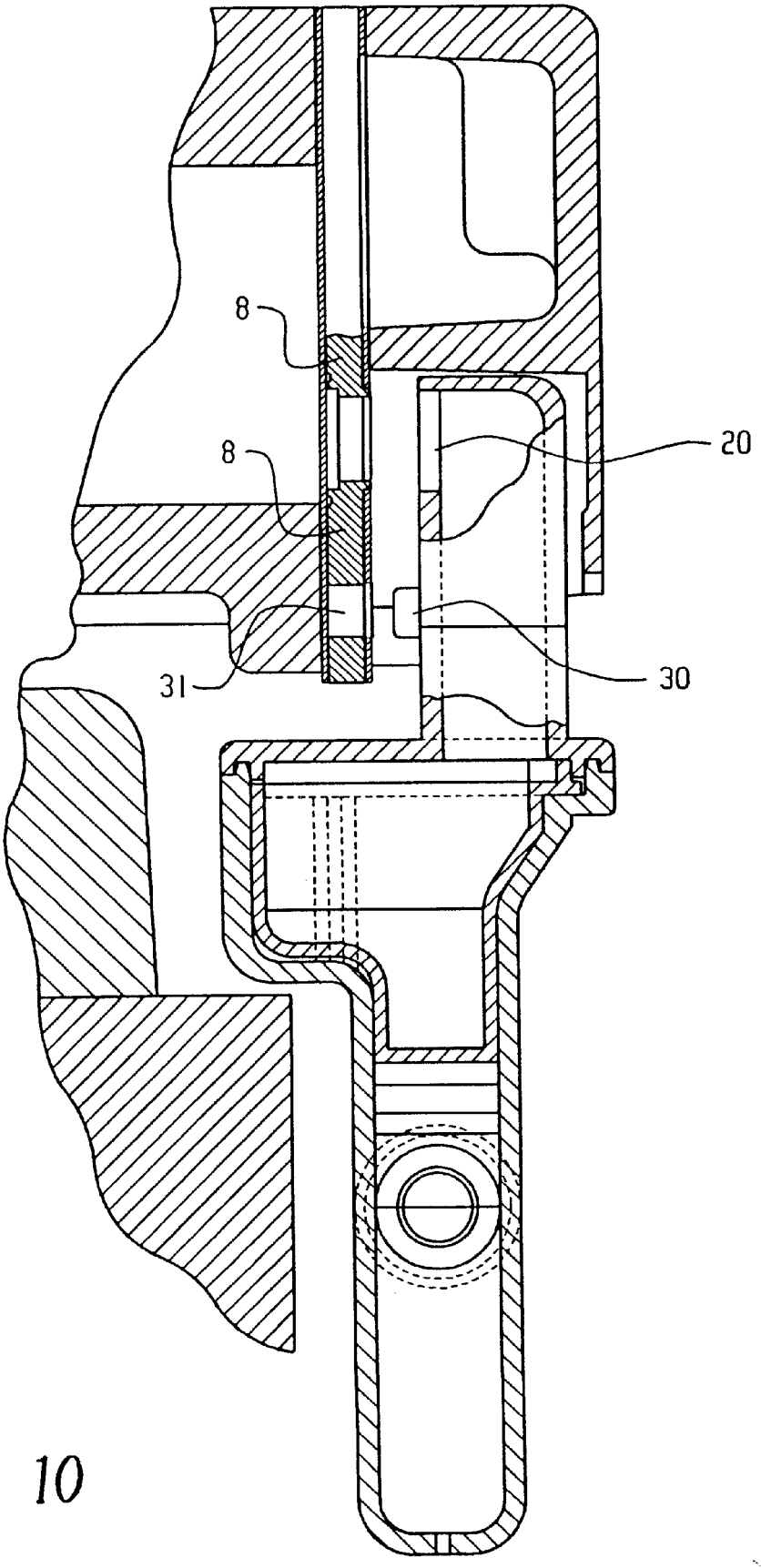

In an advantageous manner, in order to make it possible for said elastic element to be more easily and readily inserted, preferably without any use of particular tools or operations, the same element is obtained in the form of an appropriately bent high-elasticity metal leaf, as illustrated in FIG. 6. In a preferred manner, in order to ensure that it takes a correct position, said elastic leaf is provided on its outer edge 24 with an appropriate fold 25. Such a fold serves also the purpose of definitively fastening the leaf inside the hollow space. To this further purpose, said fold shall be such as to easily adapt to the projecting edge 26 of said side 7 of the projecting border 5.

An advantageous variant of the above described embodiment of the present invention consists in providing said head and the silencer with such a recess 31 and such a protrusion 30, respectively, that they are able to mutually engage, thereby consolidating the final assembly of said component parts and ensuring an exact, correct positioning thereof.

It will be appreciated that the above description and illustrations have been given, with reference to the accompanying drawings, to the mere purpose of exemplifying the present invention, and that a number of variants can be implemented and modifications can be made thereto without departing from the scope of the present invention.

What is claimed is:

1. Electric compressor, in particular for household refrigerating apparatuses, comprising a cylinder body (1), a respective head (3), a valve plate (2) arranged between said head and the body of said cylinder and provided with a gas suction opening (20), a silencer (4) arranged between the inner recess of said compressor external casing and said head of the cylinder, said silencer being formed by a central gas-suction body and an elongated portion (11) extending from said body and provided with a respective opening (12) for the ejection of the gas contained in the silencer, said opening (12) being adapted to fittingly engage said suction opening (20) in said valve plate;

said head being provided externally with a hollow seat or recess (9) that is laterally accessible towards the inner volume of said compressor;

said elongated portion (11) of the silencer being adapted to be accomodated in a firm and stable manner in said recess (9) in such a position as to enable said respective opening (12) to fittingly and tightly engagesaid opening (20) of said valve plate so as to communicatingly connect the interior of said silencer with the interior of said cylinder body, and said head being shaped in a manner that it leaves uncovered a portion (8) of the plate situated therebelow encircling said suction opening.

2. Electric compressor according to claim 1, characterized in that in said hollow space there is arranged an elastic element (24) which is adapted to act between said two surfaces (21, 22).

3. Electric compressor according to claim 2, characterized in that said said elastic element (24) is formed by means of a substantially plane metal leaf that is bent inwardly so that the two so obtained flanks thereof are capable of acting against said surfaces (21, 22), respectively.

4. Electric compressor according to claim 3, characterized in that said elastic element is provided with means (26) that are capable of engaging the outer edge of the wall (25) of said recess in a stable manner.

5. Electric compressor according to any of the preceding claims, characterized in that a protrusion (30) is provided inside said elongated portion (11), an outwardly open recess (31) is provided in said valve plate (2), and said protrusion and said recess are capable of mutually engaging in the position of final assembly of said silencer.

* * * * *